US005979468A

United States Patent [19]

Blake, III

[11] Patent Number: 5,979,468

[45] Date of Patent: Nov. 9, 1999

[54] TUBE FOR LIPSTICK AND THE LIKE

[76] Inventor: Joseph W Blake, III, 77 Locust Ave., New Canaan, Conn. 06840

[21] Appl. No.: 09/046,910

[22] Filed: Mar. 24, 1998

[51] Int. Cl.[6] ..... A45D 40/00

[52] U.S. Cl. ..... 132/318; 132/317; 132/319; 132/320; 401/59

[58] Field of Search ..... 132/317, 318, 132/319, 320; 401/59, 60; 206/581, 823

[56] References Cited

U.S. PATENT DOCUMENTS

| | | | |
|---|---|---|---|
| 2,386,417 | 10/1945 | Apfelbaum | 401/59 |
| 2,486,073 | 10/1949 | Sommer | 401/59 |
| 2,513,830 | 7/1950 | Voegeli | 410/59 |
| 3,007,569 | 11/1961 | Babin | 401/59 |
| 3,612,072 | 10/1971 | Fukui | 401/59 |
| 3,617,138 | 11/1971 | Fukui | 401/59 |
| 5,171,096 | 12/1992 | Perrotti | 401/59 |
| 5,423,622 | 6/1995 | Perrotti | 401/59 |

*Primary Examiner*—Gene Mancene
*Assistant Examiner*—Pedro Philogene
*Attorney, Agent, or Firm*—Patrick J. Walsh

[57] ABSTRACT

A lipstick tube for one-hand operation in which a sanitary case is opened at its top end, a lipstick extended for use and then retracted, and the case closed. The tube operating components include a support frame for receiving and guiding a lipstick carrier and lipstick, closure cap for opening and closing the open top of the assembled lipstick tube, a drive mechanism for engaging and axially moving the lipstick carrier and for opening and closing the closure cap, an upper and lower exterior case members.

15 Claims, 4 Drawing Sheets

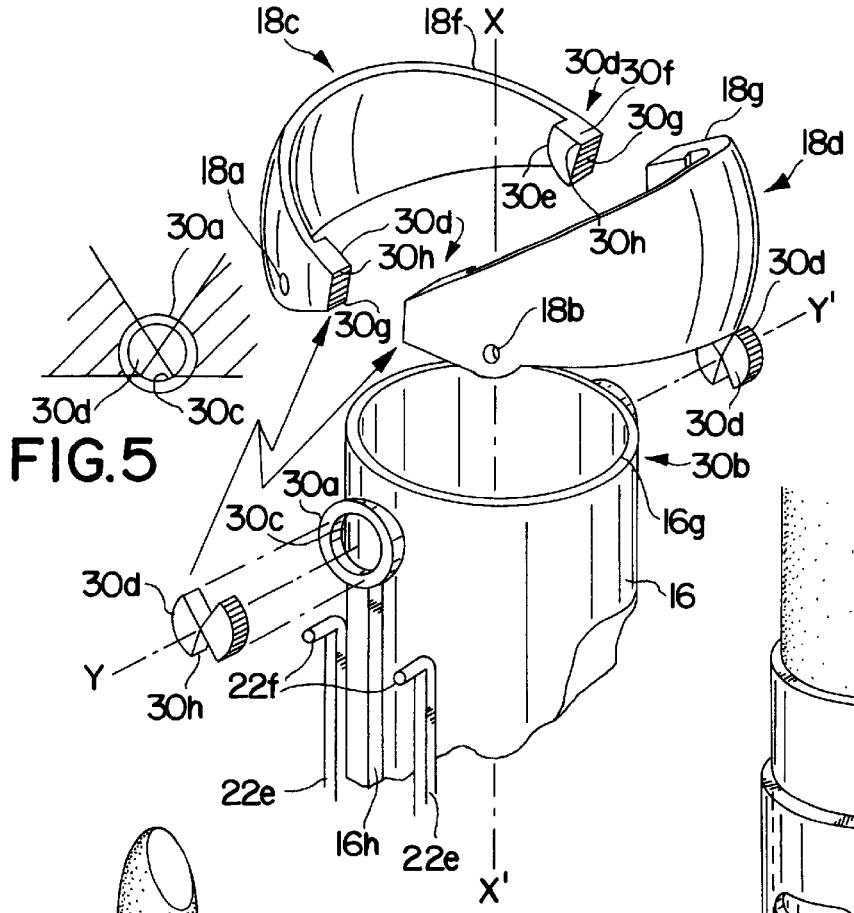
FIG.5
FIG.4
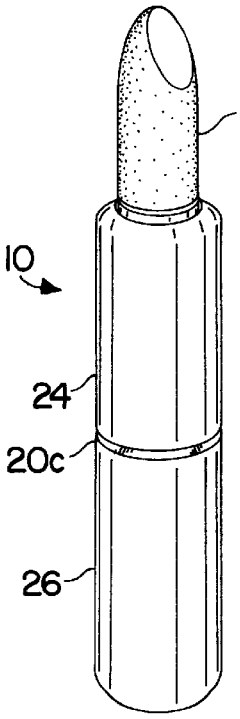
FIG.7
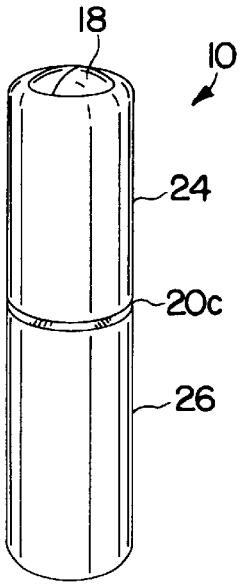
FIG.8
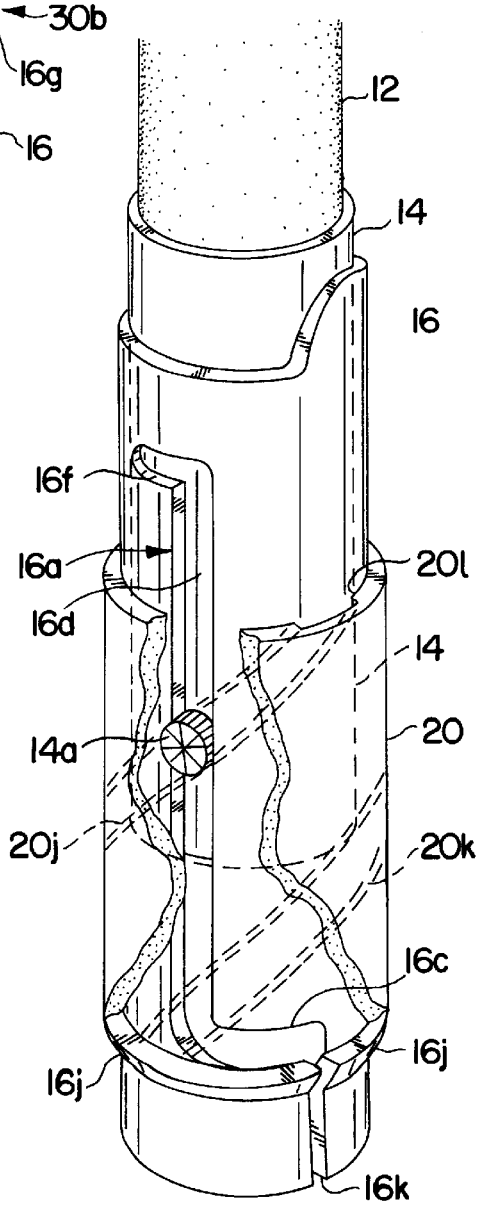
FIG.6

TUBE FOR LIPSTICK AND THE LIKE

BACKGROUND OF THE INVENTION

The present invention relates to lipstick tubes and particularly to a new and improved tube for encasing a lipstick that enables a user to open the tube, extend the lipstick from the tube, apply the lipstick, retract the lipstick, and reclose the tube with one hand.

The tube described and claimed in this application is suitable for use with lipstick as well as cosmetic brushes, eye shadow, lip liners, blushes, and other cosmetics congealed into stick form. Reference to lipstick herein is intended to embrace these and other products of this kind.

For many years lipstick has been packaged in two-piece tubes including a base portion for mounting, extending, and retracting the lipstick, together with a separate closure cap which is removed and replaced with each application of the lipstick. For applying lipstick, the cap is removed from the tube, the base portion twisted or turned to project a tip of the lipstick from the tube for application, after which the lipstick is retracted with a turn of the base, and the closure cap is replaced. In ordinary use, two hands are normally required to manipulate the tube and apply the lipstick.

Over the years, there have been attempts to develop improved lipstick tubes in sanitary casings with particular emphasis on the idea of combining the functions of opening and closing the tube and of extending and retracting the lipstick in the tube. A primary objective has been to achieve one hand operation of a lipstick tube freeing the other hand for holding a mirror as the lipstick is applied.

The patent art on the subject reveals several structures directed to efforts to improve the design and operation of lipstick tubes by incorporating a cover mechanism to uncover a lipstick tube in the motion devoted to projecting the lipstick from the tube, and to close the cover with the reverse motion for retracting the lipstick into its case.

Fullmer U.S. Pat. No. 1,979,828 discloses a lipstick case with a split movable cover that slides down the sides of the case. The cover divides into halves and is moved downwardly on the exterior of the case as the cover halves drive an internal lipstick carrier upwardly by means of a spring confined to an axially oriented U-shaped track. The Fullmer case requires two-hand operation with the apparent need for a firm grip as pressure in applying the lipstick tends push the lipstick back into the case.

Fullmer U.S. Pat. No. 2,091,312 discloses an automatic lipstick holder including an elongate case with a finger piece slidable along a slot in the side of the case for extending and retracting the lipstick. An internal cam plate linked to the fingerpiece serves to actuate a pivoted split cover member to open and close the case as the lipstick emerges and returns to position in the case. This patent discloses one hand operation as an object of the invention.

Richter U.S. Pat. No. 2,002,716 discloses a cosmetic holder having a rectangular box-like outer casing with closure doors pivoted to opposite sides for opening and closing the top end of the casing. The doors are actuated by means of limited movement of an inner casing which is actuated, along with a lipstick carrier, by means of a thumb tab moving along a slot in the outer casing. The holder is of sheet metal construction including two door panels each with four sharp corners presenting an evident hazard to the face while applying lipstick.

Kasdan U.S. Pat. No. 2,089,832 discloses a lipstick holder designed for one-hand operation. The holder is a rectangular case with an open top and includes an actuator button that slides along a slot in a side panel of the case. A flat rectangular plate opens and closes the open top. The lipstick is mounted on a carrier positioned within cooperating stationary and rotary cylindrical tubes each having cooperating slots. To operate, the actuator button slides down its slot and pulls the cover panel down into the casing opening the top for an emerging lipstick. Concurrently, the actuator button moving along its slot rotates the cylindrical tube causing the lipstick carrier to advance the lipstick through the top opening. Specifically, the rotating tube moves a pin affixed to the carrier upwardly along a cooperating slot in the stationary cylinder. So, a downward sliding movement of the actuator button causes the top to open and the lipstick carrier to move upward. Upward sliding movement of the actuator button closes the cover as it withdraws the lipstick into the casing.

Satz et al U.S. Pat. No. 2,404,815 discloses a sanitary applicator for lipstick constructed of plastic wherein lipstick is mounted on an elongate support slidably positioned in an outer casing. A thumb knob attaches to the lipstick support through a slot in the outer casing. A split cover defines a pair of pivoting doors carried by the open end of the casing. There are cooperating cam and follower surfaces on the lipstick support and on the pivoting doors so that when the thumb knob is moved forward in the slot, the cam and follower surfaces engage to open the doors as the lipstick emerges from the applicator. The patent cites manipulation by one hand as an advantage of the design. The straight axial movement of the lipstick requires the user to maintain a firm grip on the thumb knob to resist return movement of the lipstick as a result of pressure developed at the tip of the lipstick as it is applied to the lips.

Satz et al U.S. Pat. No. 2,443,361 discloses an article holder for lipstick comprising an outer open-end case with a split cover pivoted at the open end of the case. An inner sleeve has limited axial movement for camming open the cover halves. The lipstick itself is mounted on a carrier within the inner sleeve. A cup-shaped rotary actuator is fitted to the bottom of the case and when rotated actuates the inner sleeve to cam open the cover doors. Continued rotation of the actuator advances the lipstick carrier to extend the stick through the open doors. To close the device, the actuator is rotated in the reverse direction. The claim for one hand operation appearing in the earlier Satz et al patent is not repeated here.

Chabbert U.S. Pat. No. 2,463,086 discloses a control mechanism for opening and closing containers specifically a lipstick holder. The holder includes an outer tubular casing with an open top covered by a spherical cap split into two sections to act as an open and shut cover. The cap sections are pivoted to the case and to each other and are opened and closed by longitudinal reach rods connected to an actuating mechanism in the bottom of the outer casing. By rotating a handling knob at the base of the casing, the rods are moved axially to open the cover and when open, continued rotation of the knob moves the lipstick axially out of the casing for applying the lipstick. Reverse rotation withdraws the lipstick and closes the cover.

Tursky U.S. Pat. No. 2,552,697 discloses a lipstick holder defined by a generally rectangular, elongate casing with an open end for extending a lipstick on a sliding carrier. The open end is opened and closed by a shutter formed by cooperating shell shaped sections. The lipstick is advanced and withdrawn axially, and the shutter is opened and closed by a sliding the carrier forward and back on the casing. Spring fingers attached to the carrier manipulate the shutter between open and closed positions. Tursky also provides for periodic longitudinal adjustment of the position of the carrier with respect to the open end to compensate for wearing down of the lipstick with use.

Calhoun U.S. Pat. No. 2,610,732 has a pair of cover halves carried by spring fingers. The springs are bowed outwardly by upward movement of a carrier. The carrier itself is spring loaded and the finger piece is used to retract the carrier, and thereby close the case. Movement is purely axial.

Gruska U.S. Pat. No. 3,709,618 discloses a holder for a stick of pasty material mounted on a sliding carrier and covered by a split shell within a casing. As the covered lipstick advances out of the casing, the shell splits apart exposing the lipstick for application.

Perrotti U.S. Pat. No. 5,432,622 discloses a lipstick holder with movable covers wherein a rotary mechanism turning in one direction projects a lipstick and moves a closure member to open position, and by turning in the reverse direction retracts the lipstick and moves the closure member to fully closed position. The lipstick holder housing has an enlarged generally rectangular upper portion to accommodate to closure mechanism. As a result, the lipstick holder has a large housing perimeter surrounding a projecting lipstick, and as the lipstick is consumed and diminishes in length, there is an increasing tendency of the housing perimeter to interfere with lipstick application. That is, there is objectionable contact of the lip area by the housing perimeter while applying lipstick.

Perrotti U.S. Pat. No. 5,171,096 is also directed to a lipstick holder that has a more complex and detailed set of internal working parts for accomplishing the purposes of the '622 patent. The '096 housing contour is similar to that of the '622 patent with the same objectionable contact of the lip area by the housing perimeter.

French Patent No. 940,758 to Gallice is of interest in disclosing a lipstick tube with a split pivoting cap actuated by a spring member.

The foregoing patents represent an extensive effort over the last seventy years to develop a lipstick tube comprising a covered sanitary casing, reliable and repeatable one hand operation for manipulating a lipstick and opening and closing the casing, using minimal number of operating parts with inexpensive materials, and simple assembly requirements all within the space constraints attending the packing and using of lipstick.

In spite of this effort, the most widely used lipstick tube on the market today continues to be a two piece tube including cap and base wherein the cap is manually removed from the base, the lipstick is extended and retracted by a rotor and carrier in the base requiring two hand operation.

SUMMARY OF THE INVENTION

The present invention is directed to a lipstick tube for one-hand operation in which a sanitary case is opened at its top end, a lipstick extended for use and then retracted, and the case closed. The lipstick tube is held in one hand with three fingers engaging the tube base, and with the thumb and index finger engaging and turning an upper section of the tube to open a tube cover, extend the lipstick, apply the lipstick, retract the lipstick, and close the cover. The one-hand operation requires rotation in one direction for opening and extension, and in the opposite direction for retraction and closure.

The contour, dimensions, and handling weight of the tube conform substantially to those embodied in standard two piece, two-hand lipstick tubes in widespread commercial use today.

In preferred embodiment, the tube according to the invention comprises seven operating components including an interior open top tubular support frame for receiving and guiding a lipstick carrier and lipstick, a split shell closure cap for opening and closing the open top of the assembled lipstick tube, a rotary drive tube fitted over the support frame and having an interior helical groove for engaging the lipstick carrier, a cap actuating sleeve fitted to the rotary drive tube for opening and closing the closure cap, an upper and lower exterior case members.

All of the parts are fabricated of light weight materials and easily assembled into a smoothly functioning unit, wherein by rotating the upper outer case, the rotary drive tube retracts the cap actuating sleeve to open the closure as the drive tube advances the lipstick carrier to axially extend the lipstick for use. The lipstick extends through an opening in the upper casing member. The entire outer casing is cylindrical and conforms closely to the perimeter of the lipstick.

The rotary motion required is easily given to the tube by the index finger and thumb applying a very light turning pressure to the upper case section.

OBJECTS OF THE INVENTION

An object of the invention is to provide a lipstick tube capable of one-hand operation.

Another object of the invention is to provide a lipstick tube for sanitary packaging of a lipstick by means of an outer casing and a split shell cap for opening and closing the casing.

Another object of the invention is to provide a lipstick tube with a minimum number of easily assembled smoothly interacting parts.

Another object of the invention is to provide a lipstick tube for one-hand operation having the look and feel of standard lipstick tubes.

Another object of the invention is to provide a lightweight lipstick tube enabling one-hand operation with a light touch.

Other and further objects of the invention will become apparent with an understanding of the following detailed description of the invention or upon employment of the invention in practice.

DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which:

FIG. 4 is an enlarged, exploded, fragmentary perspective view illustrating closure cap components of the lipstick tube.

FIG. 5 is a schematic elevational view illustrating the position of a set of closure cap pivot blocks in their mounting ring for defining the opening and closing motions of the cooperating cap shells.

FIG. 6 is an enlarged perspective view of a subassembly of lipstick and its carrier, support frame, and fragmentary drive tube.

FIG. 7 is a perspective view of the assembled lipstick tube ready for application of lipstick.

FIG. 8 is a perspective view of a closed lipstick tube.

DETAILED DESCRIPTION OF THE PREFERRED EMBODIMENT

Figure 1:
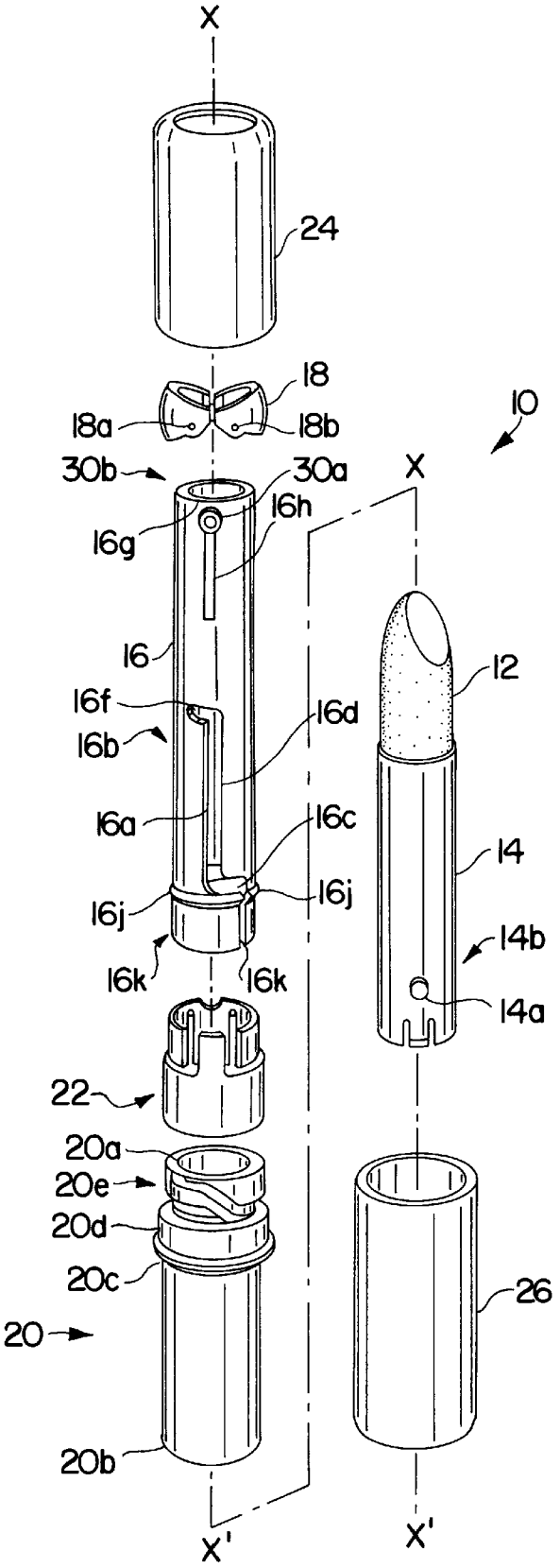
FIG. 1 is an exploded view of the component parts of the lipstick tube according to the invention.

Referring to FIG. 1 of the drawing, a preferred embodiment of the lipstick tube 10 comprises a lipstick 12 mounted on a carrier 14 which together fit inside a support frame 16, a closure cap 18, a drive tube 20, a closure cap actuating sleeve 22, and upper 24 and lower 26 exterior case sections. When assembled the components lie along a longitudinal axis x–x' of the tube.

The lipstick carrier comprises an elongate open ended tube 14 with a lipstick 12 extending from its upper end, and with tracking lugs 14*a–b* projecting radially from diametrically opposite sides of the lower end of the carrier wall. The lugs register with corresponding Z-shape slots 16*a–b* in the support frame 16 and extend through the Z-shape slots for engagement with helical grooves 20*j–k* (FIG. 6) along the inner surface 20*l* of the drive tube 20.

The support frame 16 (FIGS. 1, 6) is preferably a cylindrical open ended tube with Z-slots 16*a–b* at diametrically opposed positions in its side wall for receiving the carrier tracking lugs 14*a–b* in order to guide movement of the lipstick and carrier. The lower horizontal leg 16*c* of each Z-slot accommodates an initial rotary movement of the lipstick which movement is in part a delaying motion to allow for closure cap opening before the lipstick moves axially as guided by the vertical leg 16*d* of each Z-slot. The upper horizontal leg 16*f* of each Z-slot acts as a supporting station for holding the lipstick and carrier in vertically extended position for application of lipstick. The supporting stations act to resist downward axial force on the lipstick as it is applied in use.

The support frame 16 (FIGS. 1, 4–5) further includes a pair of external, diametrically opposed radially projecting recess rings 30*a–b* for mounting the closure cap 18 at the top open end 16*g* of the frame, a vertically extending rib 16*h* for limiting movement of the cap actuating sleeve to axial only, an integral retaining ring 16*j* for keeping the drive tube in position on the frame, and vertically extending slits 16*k* for accommodating assembly of the drive tube onto the support frame. That is, the support frame flexes at the slits as the drive tube is pushed onto the frame over the retaining ring during assembly. The lower edge of the vertical rib 16*h* cooperates with the top edge 20*a* of the drive tube serving as an upper limit to drive tube movement along the support frame. The rib 16*h* together with the retaining ring 16*j* confine the drive tube axially of the support frame while accommodating free rotation thereabout.

As noted below in detail, the support frame 16 is affixed to the lower exterior case section 26, and together the frame and lower case section constitute stationary components of the lipstick tube with other tube components movable with respect to them.

Figure 9:
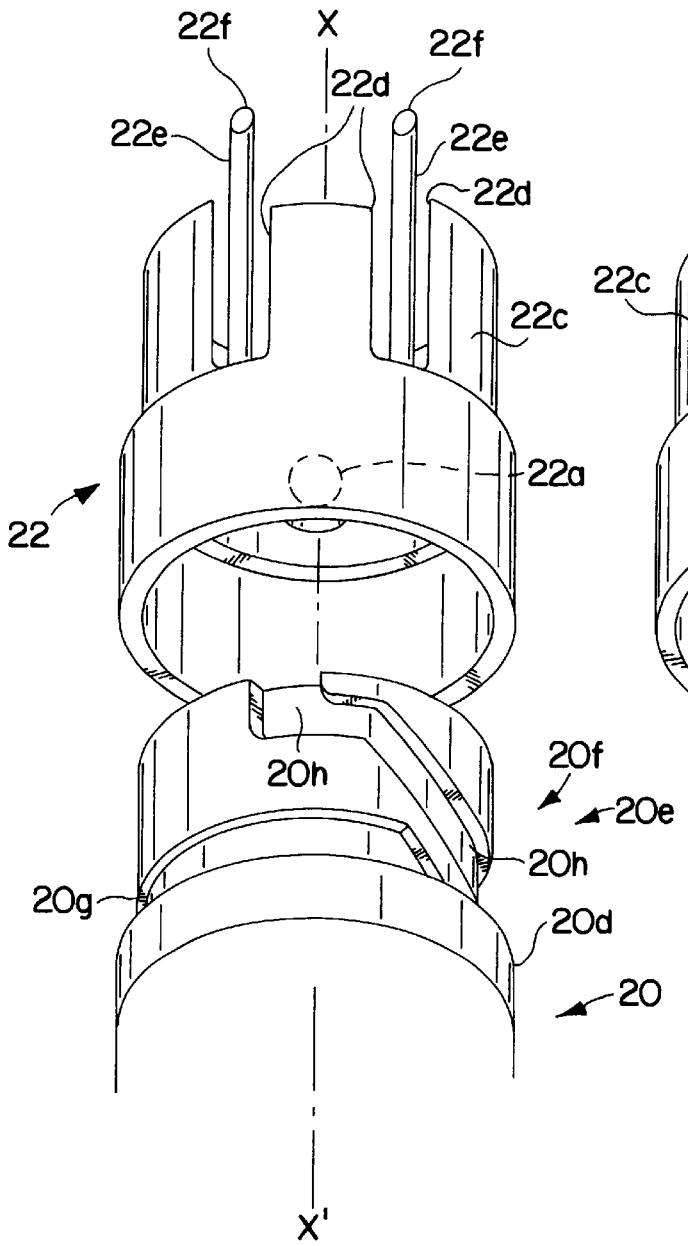
FIG. 9 is an enlarged fragmentary perspective view of the under side of the cap actuating sleeve in exploded relation to the cam groove of the drive tube.
Figure 10:
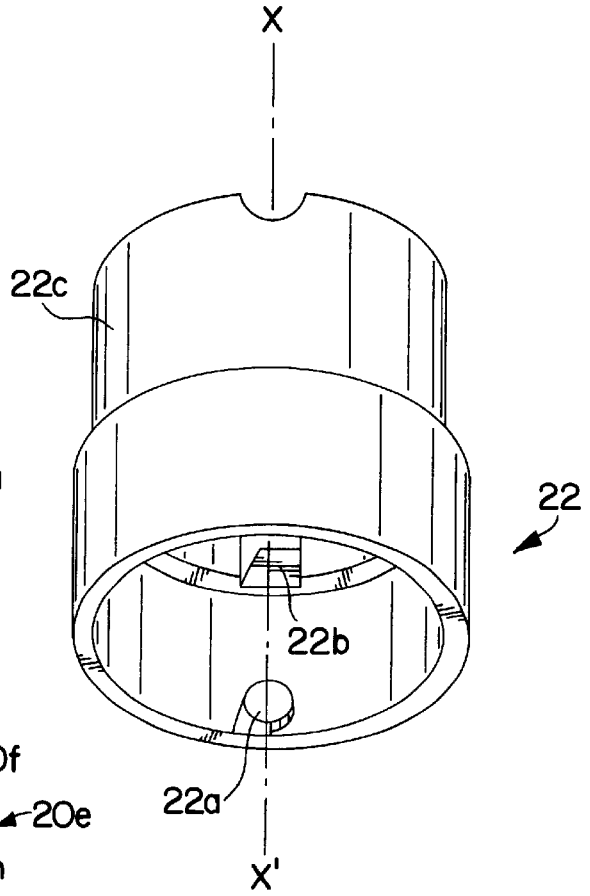
FIG. 10 is an enlarged fragmentary perspective view of the under side of the cap actuating sleeve rotated 180° from the sleeve position of FIG. 9.

The rotary drive tube 20 is an open-ended cylindrical tube with a lower skirt portion 20*b* below an annular shoulder 20*c*, an annular surface 20*d* (i.e., cylindrical plane) above the shoulder for receiving and holding the upper exterior case section 24 in a friction fit, and an upper cam section 20*e* for receiving and regulating axial movement of the cap actuating sleeve 22. The cam section 20*e* (FIG. 9) comprises a cam groove 20*f* with a lower annular (horizontal) portion 20*g*, a ramp portion 20*h*, and an upper horizontal segment 20*h*. The cam groove cooperates with a cam follower 22*a* (FIGS. 9–10) on the interior surface of the cap actuating sleeve so that as the drive tube rotates left and right the cap actuator sleeve 22 oscillates vertically.

The drive tube 20 (FIG. 6) has diametrically opposed helical grooves 20*j–k* formed along its inner surface 20*l*. The drive tube receives the lipstick carrier 14 and support frame 16 subassembly with the carrier tracking lugs 14*a–b* extending through the Z-slots 16*a–b* and engaging the helical grooves 20*j–k*. With rotation of the drive tube about the support frame, and with each carrier tracking lug 14*a–b* confined to the intersection of its respective Z-slot 14*a–b* and helical groove 20*j–k* as in FIG. 6, the lipstick carrier will move vertically with respect to the frame projecting the lipstick from the upper end thereof.

Figure 2:
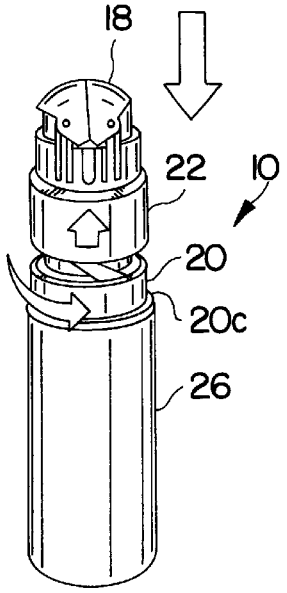
FIG. 2 is a perspective view of an assembled tube (excluding the upper case) showing the tube in closed position.
Figure 3:
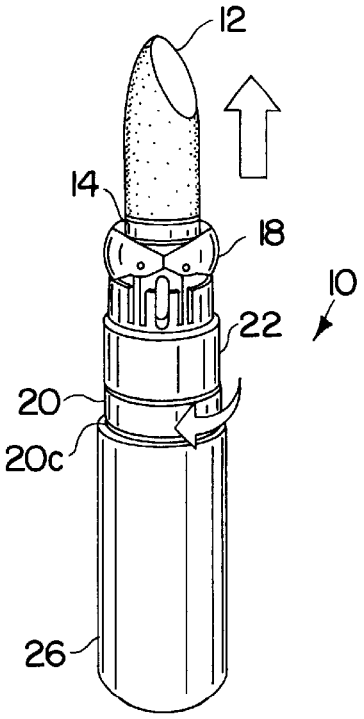
FIG. 3 is a perspective view of an assembled tube (excluding the upper case) showing the tube in open position.

The rotary drive tube 20 has an annular shoulder 20*c* (FIGS. 1–3) below which the tube is cylindrical for receiving in loose fit the lower portion 26 of the exterior case.

The cap actuating sleeve 22 (FIGS. 9–10) is fitted to the top of the drive tube with a cam follower 22*a* on the inner surface of the sleeve engaging the drive tube cam groove 20*f*. Relative rotation of the drive tube and the cap actuating sleeve produces axial movement of the sleeve. A vertically extending recess 22*b* along the inner surface of the cap actuating sleeve registers with the rib 16*h* (FIGS. 1 & 4) along the support frame for limiting cap actuator sleeve movement to axial only. The rib/recess registry accommodates sliding axial movement and resists the tendency of the sleeve to be carried along in rotation with the drive tube.

The cap actuating sleeve has an upper cuff 22*c* of reduced diameter, and with the cuff wall notched 22*d* to define spaced upwardly directed actuating links 22*e* lying in the cylindrical plane encompassing the cuff.

The actuating links each have a pin 22*f* at the upper end fitting into receptor holes 18*a–b* (FIGS. 4, 11) in the split closure cap 18. The pins extend radially outward from the links, and engage the receptor holes from the inside of the closure cap. Vertical reciprocating movement of the actuating links moves the segments of the closure cap into open and closed relation to the open top of the support frame.

Recess rings 30*a–b* (FIGS. 4–6, 12, 13) located at diametrically opposite sides adjacent the open top end of the support frame mount the split closure cap. The recess rings define a diametric pivot axis y–y' for the cooperating portions of the cap. The pivot axis is normal to the long axis x–x' of the tube. The rings have cylindrical inner surfaces 30*c* for guiding the closure cap sections pivoting between open and closed positions.

The closure cap 18 is split comprises mirror image cooperating shells 18*c–d* in the form of spherical segments with a diameter sufficient to span the open end 16*g* of the support frame so that pivot blocks 30*d* at the inner ends of the shells fit into and pivot with respect to the recess rings. As noted receptor holes 18*a–b* at a lower edge of the shells receive the end pins 22*f* of the actuating links 22*e* for opening and closing the shells by pivotal movement with respect to the pivot axis of the recess rings.

Figure 11:
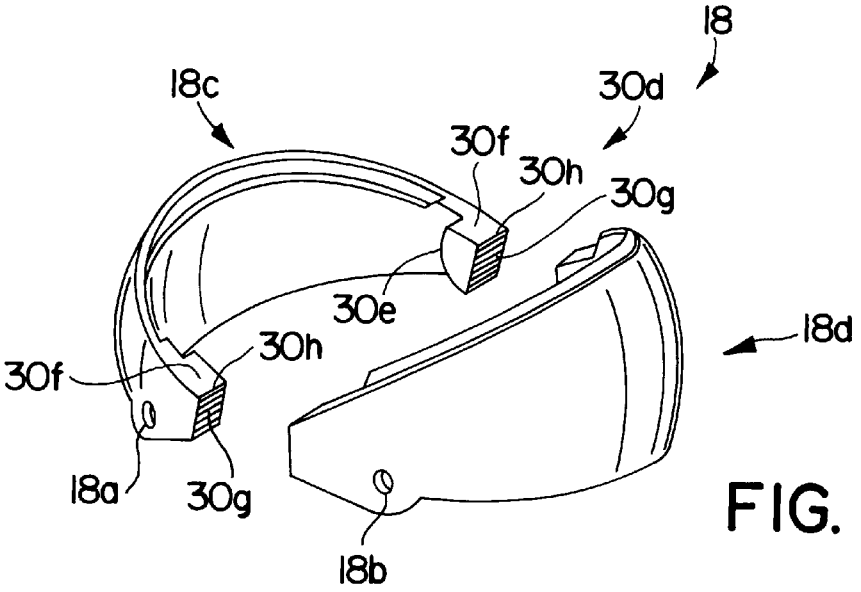
FIG. 11 is a perspective view of the closure cap shells showing a tongue and groove arrangement for the closing edges of the shells.
Figure 12:
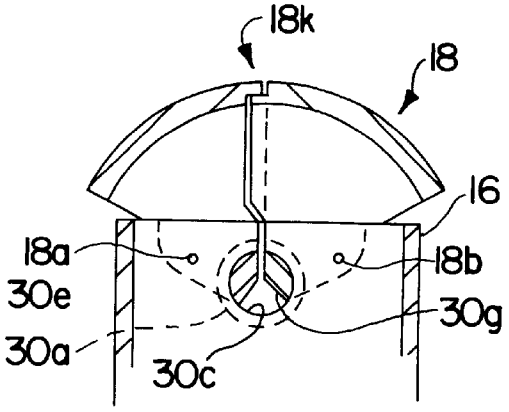
FIG. 12 is a section view of the closure cap in closed position.
Figure 13:
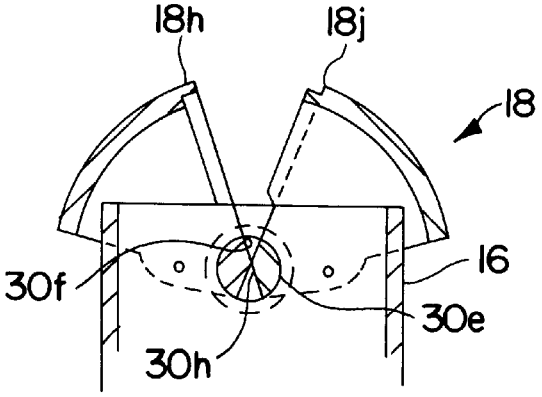
FIG. 13 is a section view of the closure cap in partially open position.

Each of the pivot blocks (FIGS. 4, 11–13) is defined by an outer cylindrical surface 30*e*, and inner upper 30*f* and lower 30*g* planar surfaces intersecting at an inner apex 30*h*. The inner apex, the upper planar surfaces and the inner peripheral edges 18*f–g* of the shells all lie in a common plane with the planes of both shell halves coinciding to enable complete closure (i.e., complete contact of the peripheral edges) of the shells over the top end of the lipstick tube. As shown in FIGS. 11–13 the facing surfaces 18*h–j* of the peripheral edge have a tongue and groove 18*k* mating relationship effecting a sanitary closure of the cap over the lipstick.

The cylindrical surfaces 30*e* of the pivot blocks engage the inner surface 30*c* of the recess rings wherein the shell halves pivot within the recess rings. The apexes 30*h* lie along the diametric pivot axis y–y' and act as cooperating fulcrums to accommodate the pivoting action of the shells.

The lower planar surfaces 30*g* abut each other to define the limit of movement of the shell halves in the open position.

Together, the closure shells form a dome of sufficient surface area to completely close the opening in the top end of the upper exterior case in a sanitary manner.

For assembly, the lipstick carrier fits within the support frame with the carrier tracking lugs fitted into the Z-slots in the frame wall. The drive tube subassembled with the cap actuating sleeve snaps onto the exterior of the support frame and is positioned between the retaining ring and the lower edge of the frame vertical rib. The carrier tracking lugs project through the frame Z-slots and register with the helical grooves along the inner surface of the drive tube. The closure cap shells are fitted by their pivot blocks to the recess rings, with the actuating link pins fitted into the shell receptor holes. The upper exterior case snugly engages the annular face of the drive tube so that the two rotate as a unit without slipping. The lower case fits loosely over the lower skirt of the drive tube and is rigidly affixed to the lower end of the support frame.

In operation, the support frame and the lower exterior case are rigidly attached to each other and are to be regarded as stationary in a description of relative movement and operation of the lipstick tube assembly. By holding the lower exterior case of the tube of FIG. 8 in three fingers of one hand, and by rotating the the upper case with the thumb and index finger, the upper exterior case and drive tube rotate as a unit moving the cap actuating sleeve axially from the position of FIG. 2 to FIG. 3. In the FIG. 2 position, the cam follower of the cap actuating sleeve is at the upper horizontal position in the cam groove, and as it moves down the ramp portion of the groove, the closure cap opens to the position of FIG. 3. This action results in the actuating links pivoting the closure shells to open position. (The lower horizontal portion of the cam groove is a "dwell" position for the cam follower in order to accommodate continued rotation of the drive tube to achieve lipstick extension and retraction). It is to be observed that this opening of the shell halves is accomplished with a very short axial movement of the actuating links. Next, continued rotation of the exterior case and drive tube brings the lipstick carrier tracking lugs to position at the base of the frame Z-slots. As drive tube rotation continues, the carrier lugs, also being in engagement with the driving tube helix grooves, lift the carrier to extend the lipstick through the open end of the tube. Rotation of the drive tube ends with the carrier tracking lugs resting in the horizontal stop portion of the frame Z-slots to stay the carrier in extended position.

Reverse rotation withdraws the carrier and lipstick into the interior of the tube and closes the closure cap.

The overall length of the of the lipstick tube is independent of the functioning of the several operating components, and so tube length can be selected according to marketing, appearance, or other extraneous considerations.

Various changes may be made to the structure embodying the principles of the invention. The foregoing embodiments are set forth in an illustrative and not in a limiting sense. The scope of the invention is defined by the claims appended hereto.

I claim:

1. A lipstick tube comprising a cylindrical open top end support frame having guide means therein, a closure cap for opening and closing the top end of the support frame, a lipstick and carrier assembled inside the support frame, the carrier having follower means engaging the frame guide means, an open ended drive Lube fitted over the support frame for rotation with respect to the support frame, the drive tube having an interior surface and guide means on the interior surface, the carrier follower means engaging the drive tube guide means, the drive tube having open ends and further having an annular face intermediate the open ends and a surface cam groove, a closure cap actuating member fitted to the drive tube in operative relation to the surface cam groove, the cap actuation member having means for engaging the closure cap for opening and closing the closure cap with respect to the open top end of the support frame, a lower exterior case affixed to the support frame in covering relation to a portion of the drive tube, an upper exterior case having an open end adjacent and concentric with the open end of the support frame, the upper exterior case fitted to the annular face of the drive tube for rotation with the drive tube so that rotation of the upper case with respect to the lower case in one direction opens the closure cap, extends the lipstick through the open ends of the support frame and upper case, and rotation in the opposite direction retracts the lipstick and closes the closure cap.

2. A mechanism for opening and closing a closure cap for a lipstick tube comprising an open ended tubular support frame, a closure cap fitted to the support frame in covering relation to the open end, a drive tube mounted for rotation on the support frame, the drive tube having a cam surface thereon, a cap actuating sleeve fitted to the drive tube in operative relation to the cam surface, the cap actuating sleeve having means for engaging the closure cap for manipulating the closure cap between open and closed positions whereby rotation of the drive tube in one direction with respect to the closure cap opens the closure cap with respect to the open end of the support frame, and rotation in the opposite direction closes the closure cap with respect to the open end of the support frame.

3. A closure cap for a lipstick tube and a mechanism for opening and closing the closure cap comprising an open ended tubular support frame, a pair of rings fitted to the outer surface adjacent the open end of the support frame diametrically opposite to each other, the rings defining a pivot axis for the closure cap, the closure cap including a pair of cooperating spherical shell segments, each shell segment having diametrically spaced pivot means for engaging the rings and for moving in open and closed relation to the open end of the tube, a drive tube mounted for rotation on the support frame, the drive tube having a cam surface thereon, a cap actuating sleeve fitted to the drive tube in operative relation to the cam surface, the cap actuating sleeve having means for engaging the closure cap shell segments for manipulating the closure cap between open and closed positions whereby rotation of the drive tube in one direction with respect to the closure cap opens the closure cap with respect to the open end of the support frame, and rotation in the opposite direction closes the closure cap with respect to the open end of the support frame.

4. A closure cap for a lipstick tube and a mechanism for opening and closing the closure cap comprising an open ended tubular support frame, a pair of rings fitted to the outer surface adjacent the open end of the support frame diametrically opposite to each other, the rings defining a pivot axis for the closure cap, the closure cap including a pair of cooperating spherical shell segments, each shell segment having diametrically spaced pivot means for engaging the rings and for moving in open and closed relation to the open end of the tube, each shell segment having means spaced from the pivot axis for manipulation of each shell segment with respect to the pivot axis, a drive tube mounted for rotation on the support frame, the drive tube having a cam surface thereon, a cap actuating sleeve fitted to the drive tube in operative relation to the cam surface, the cap actuating sleeve having means for engaging the closure cap shell segments means for manipulating the closure cap about the pivot axis between open and closed positions whereby rotation of the drive tube in one direction with respect to the closure cap opens the closure cap with respect to the open end of the support frame, and rotation in the opposite direction closes the closure cap with respect to the open end of the support frame.

5. A closure cap for a lipstick tube and a mechanism for opening and closing the closure cap comprising an open ended tubular support frame, a pair of recessed rings fitted at diametrically opposite locations to the outer surface adjacent the open end of the support frame, the rings defining a pivot axis for the closure cap, the rings further having an inner pivot guide surfaces for the closure cap, the closure cap including a pair of cooperating spherical shell segments, each shell segment having diametrically spaced pivot blocks with cylindrical surface segments for engaging the pivot guide surfaces of the rings, each shell segment having receptor holes along an edge thereof, each shell segment for moving in open and closed relation to the open end of the tube, a drive tube mounted for rotation on the support frame, the drive tube having a cam surface thereon, a cap actuating sleeve fitted to the drive tube in operative relation to the cam surface, the cap actuating sleeve having actuating links for engaging the receptor holes of the closure cap shell segments for manipulating the closure cap between open and closed positions whereby rotation of the drive tube in one direction with respect to the closure cap opens the closure cap with respect to the open end of the support frame, and rotation in the opposite direction closes the closure cap with respect to the open end of the support frame.

6. A closure cap for an open end of a lipstick tube comprising identical spherical segments each having a peripheral edge lying in a plane, each spherical segment having diametrically spaced pivot blocks, each pivot block having a pivoting guide surface in the form of a cylindrical segment, upper and lower planar surfaces terminating in an apex, the upper planar surfaces lying of each segment lying in the segment plane, the upper planar surfaces of the segments abutting each other to define a closed position of the closure cap over the open end, the lower planar surfaces abutting to define the open position of the closure cap with respect to the open end, and the apexes of the pivot blocks being cooperating fulcrums for pivotal movement of the cap segments.

7. A closure cap as defined in claim 6 in which the peripheral edges of the segments meet in a tongue and groove joint when the cap is closed.

8. A lipstick tube comprising a cylindrical lower ceasing and an cylindrical upper casing, the casings together comprising a hollow receptacle having a long axis, an opening through the top end of the upper casing, a closure cap for opening and closing the top end of the upper casing, a lipstick mounted within the hollow receptacle aligned with the long axis for reciprocating movement with respect to said axis, the upper casing mounted for rotation with respect to the lower casing, drive means including a cap actuating sleeve and a rotary drive tube, said drive means responsive to rotation of the upper casing in a first direction for opening the closure cap, moving the lipstick along said axis to extend through the opening, said drive means being further responsive to rotation of the upper casing in the opposite direction for retracting the lipstick along said axis, and closing the closure cap.

9. A lipstick tube as defined in claim 8 wherein the lower casing is held by three fingers of one hand while the upper casing is rotated in the first direction and the opposite direction by the thumb and forefinger of said one hand.

10. A drive mechanism for a lipstick tube comprising a lipstick, an open ended cylindrical support frame, a Z-slot in the support frame having a vertical leg, an upper horizontal leg, and a lower horizontal leg, a carrier for the lipstick, the carrier and lipstick fitted into the support frame for axial movement with respect to the frame, the carrier having a lug extending through the Z-slot, a drive tube fitted onto the support frame for rotation with respect thereto, the drive tube having an inner surface and a helical groove on the inner surface, the carrier lug in engagement with the helical groove, whereby rotation of the drive tube moves the carrier lug along the lower horizontal leg, up the vertical leg, and into the upper horizontal leg for moving the lipstick axially with respect to the support frame, and supporting the lipstick and carrier against vertical movement by means of the upper horizontal slot.

11. A lipstick tube arranged along a longitudinal axis comprising stationary components, driven components and a driving mechanism:

a. the stationary components including a cylindrical exterior lower case having closed bottom end and open top end, a cylindrical tubular wall open ended support frame affixed to the lower case with the frame and case each aligned with said axis, the support frame having a wall and guide slot means in the wall and closure cap support means positioned adjacent the top end thereof, b. the driven components including a lipstick mounted on a carrier coaxially positioned for reciprocating axial movement within the support frame, the carrier having slot follower means extending into the support frame guide slot means, and a closure cap mounted on said frame support means for pivotal movement on a lateral axis normal to the longitudinal tube axis for opening and closing the open top end of the support frame, c. the driving mechanism including a drive tube fitted over the support frame in coaxial relation thereto and adapted to rotate freely with respect to the support frame, the drive tube having helical groove means engaged by the carrier slot follower means, a cam slot in the surface of the drive tube, a cap actuator fitted to the drive tube in operative relation to the cam slot and adapted to move axially with respect to the drive tube, the cap actuator being restrained against rotary movement with respect to the longitudinal axis, the cap actuator in operative relation to the closure cap for pivoting the cap with respect to the lateral axis, an upper exterior cylindrical case fitted to the drive tube for rotation with the drive tube, the case having an upper open end adjacent to and concentric with the support frame open end, whereby rotary movement applied through the upper exterior case to the drive tube in a first direction about the longitudinal axis opens the closure cap and extends the lipstick through the open end of the support frame, and rotation of the upper exterior case in the opposite direction retracts the lipstick into the support frame and closes the closure cap.

12. A lipstick tube as defined in claim 1 in which the support frame has a vertically oriented rib and the cap actuator has a vertically oriented slot, wherein the rib and slot engage to permit axial movement and prevent rotary movement of the cap actuator sleeve.

13. A drive mechanism for a lipstick tube in which a lipstick is fitted to a carrier and positioned coaxially within a support frame and the support frame is fitted with a closure cap to pivot between open and closed positions with respect to an open end of the support frame, the drive mechanism including a drive tube fitted over the support frame in coaxial relation thereto and adapted to rotate freely with respect to the support frame, the tube having a helical groove extending along the drive tube being engaged by the carrier, a cam slot in the surface of the drive tube, a cap actuator fitted to the drive tube in operative relation to the cam slot and adapted to move axially with respect to the drive tube, the cap actuator being restrained by the support frame against rotary movement, the cap actuator in operative relation to the closure cap for pivoting the cap between open and closed positions, whereby rotary movement applied to the drive tube in a first direction opens the closure cap and extends the lipstick through the open end of the support frame, and rotation in the opposite direction retracts the lipstick into the support frame and closes the closure cap.

14. A lipstick tube having a longitudinal axis comprising a cylindrical carrier, a lipstick mounted on the carrier, a cylindrical support frame mounting the lipstick and carrier for movement within the support frame along said axis, the support frame having an open top end, a closure cap pivotally mounted on the support frame for opening and closing the top end of the frame, a cylindrical drive tube mounted on the support frame for rotation about said axis, the drive tube being in operative engagement with the carrier for moving the lipstick along said axis, a cylindrical cap actuating sleeve mounted on the drive tube operatively linked to the closure cap for opening and closing the closure cap, a cylindrical lower exterior case and a cylindrical upper exterior case together defining the outer casing of the lipstick tube, the upper case having an open top end concentric with the open top end of the support frame through which the lipstick extends for application.

15. A lipstick tube having a longitudinal axis comprising a cylindrical carrier, a lipstick mounted on the carrier, a cylindrical support frame mounting the lipstick and carrier for movement within the support frame along said axis, the support frame having an open top end, a closure cap pivotally mounted on the support frame for opening and closing the top end of the frame, a cylindrical drive tube mounted on the support frame for rotation about said axis, the drive tube being in operative engagement with the carrier for moving the lipstick along said axis, a cylindrical cap actuating sleeve mounted on the drive tube operatively linked to the closure cap for opening and closing the closure cap, a cylindrical lower exterior case and a cylindrical upper exterior case together defining the outer casing of the lipstick tube, the upper case having an open top end concentric with the open top end of the support frame through which the lipstick extends for application, and the upper case fitted to the drive tube for rotating the drive tube, and the lower case fitted to the support frame so that in operation of the tube the upper case rotates with respect to the lower case.

* * * * *